United States Patent [19]

Wilcox

[11] Patent Number: 4,677,977

[45] Date of Patent: Jul. 7, 1987

[54] MASK FOR PRESSURE BREATHING

[75] Inventor: Orland W. Wilcox, Pasadena, Calif.

[73] Assignee: Gentex Corporation, Carbondale, Pa.

[21] Appl. No.: 637,398

[22] Filed: Aug. 3, 1984

[51] Int. Cl.[4] ..... A62B 7/00

[52] U.S. Cl. ..... 128/206.24

[58] Field of Search ..... 128/204.18, 204.29, 128/205.25, 206.21, 206.24, 206.26, 206.28, 207.11, 201.23

[56] References Cited

U.S. PATENT DOCUMENTS

| | | | |
|---|---|---|---|
| 2,133,699 | 10/1938 | Heidbrink | 128/206.24 |
| 2,166,164 | 7/1939 | Lehmberg | 128/206.24 |
| 2,465,973 | 3/1949 | Bulbulian | 128/206.24 |
| 2,837,090 | 6/1958 | Bloom et al. | 128/207.11 |
| 2,939,458 | 6/1960 | Lundquist | 128/206.24 |
| 2,970,593 | 2/1961 | Seeler | 128/201.23 |
| 3,079,917 | 3/1963 | Pate | 128/201.23 |

*Primary Examiner*—Henry J. Recla

*Attorney, Agent, or Firm*—Donald D. Mon

[57] ABSTRACT

A face mask for pressure breathing. The mask has a body with a sealing boundary shaped to fit over the bridge of a wearer's nose, downward past the sides of his nose and mouth and across his mental protuberance. The sealing boundary includes a reflective primary seal and a secondary seal. The reflective seal lays flexibly against the wearer's face. The secondary seal is relatively rigid relative to the reflective seal so as to indent into the face when pressed against it in order to respond to stringent conditions of g forces and differential pressures.

9 Claims, 5 Drawing Figures

11
25
2
3
22
15
24
21
10
20
12
30
13
61
60
4
25
35

12
22
30
20
23
24

13

14
20
30
41

20
50
30
51

2
1
60

33
32
31
35
1

MASK FOR PRESSURE BREATHING

FIELD OF THE INVENTION

This invention relates to face masks for use in pressure breathing systems.

BACKGROUND OF THE INVENTION

In high performance, high altitude flight, it is necessary to provide personnel with positive pressure breathing apparatus. Such systems are especially needed when the body is exposed to very low pressure. Then survival depends upon supplying correct gas mixtures at pressures which properly ventilate and pressurize the body's breathing system. Masks worn against the face, which cover the nose and mouth, are well known. These function acceptably at relatively small differential pressures between mask pressure and ambient pressure. Such masks frequently have a reflective seal which gently bears against the skin and is deflected by mask pressure to form a seal with the skin. In order to maintain the mask pressure, the seal must prevent blow-by of the breathing gases.

Masks with reflective seals function acceptable at altitudes where the differential pressure is on the order of about 6 inches to 8 inches of water. However, at much higher altitudes, where the differential may be on the order of perhaps 35 inches of water, reflective seals are not sufficiently reliable, and blow-by becomes a risk.

The shortcomings of reflective seals arise in part from the characteristics of skin and in part from the variability of facial configurations of the wearers. When the reflective seal contacts the skin, it does not meet a clean and flat surface. Instead, the skin may be pocked, pitted, locally enlarged, and wrinkled. Furthermore it is customary to provide only a limited number of mask configurations and sizes, and for the wearer to select the most suitable member of the group for his personal use. As a consequence, even though the mask will be made of relatively flexible and conformable material, still for many wearers, the flexing which occurs when the mask is pulled against the face may in some localized regions, especially over the bridge of the nose, permit blow-by. The more different the wearer is from the "average" face, the greater is the risk of such an event.

It is theoretically possible to avoid all risk of blow-by by providing an individually and precisely conforming rigid or nearly rigid seal, and pressing it against the face so that it deeply indents the skin to form a force seal. This is of course an intolerable situation, if only because of the discomfort it will cause to the wearer and of the impediment to his blood circulation.

It is an object of this invention to provide a breathing mask which can utilize the relatively gentle features of the reflective seal for operations which involve modest differential pressures, and a relatively more rigid secondary seal which is brought into operation at greater differential pressures to form a force seal, but without requiring excessive rigidity or full-time application that are likely to cause discomfort.

There are additional problems involved in such high performance breathing masks. One is that the larger the frontal area of the mask, which develops with the larger differential pressure a force to force the mask away from the face, the larger is the force needed to hold the mask against the face. This can lead to discomfort. Another is that when the airman undergoes high negative G forces, in the sense of enduring tight high speed pulls out of dives, and high speed inside turns, forces are developed which tend to slide the mask down his face, which could lead to blow-by as well as to possible loss of the mask itself. It is a further object of this invention to provide a mask whose frontal area is minimized, and which is conformed so as to be supported by the mental protuberance of the chin during negative G events.

BRIEF DESCRIPTION OF THE INVENTION

A breathing mask according to this invention is adapted to form a sealing boundary which extends over the bridge of the nose, downwardly at each side of the nose and mouth, and across the mental protuberance of the chin in order to make a continuous seal with the facial skin. A canopy is formed within this boundary to overlay the wearer's nose and mouth. Hose connections can be made to and through the canopy, which is ported for this purpose.

Along the boundary there is a primary seal which is reflective. By the term "reflective" is meant a flexible flange which makes contact with the skin, and which is biased into contact with the skin by a positive differential pressure in the mask. In accordance with this invention, it makes an initial contact near its free edge, and the area of contact increases as the mask is pressed farther towards the skin. This seal makes an initial included angle with the skin preferably on the order of about 30 degrees, and projects toward the inside of the mask.

Adjacent to, outside of the primary seal, and extending along the sealing boundary, there is a secondary seal. This is relatively rigid, although it is pliable to conform to variations in facial configurations.

It acts as a force seal whose function is to press into the skin when the mask is strongly pushed against the face. This makes a more positive seal against blow-by. It is more reliable than the reflective seal at higher differential pressures, but is less comfortable.

According to a preferred but optional feature of the invention, a hard cap is placed over the breathing mask, and the breathing mask has a ledge in alignment with the major portion of the secondary seal so that the cap can be pressed against the ledge to act as a force means to press the secondary seal into operation.

The above and other features of this invention will be fully understood from the following detailed description of the accompanying drawings, in which:

DETAILED DESCRIPTION OF THE INVENTION

Figure 1:
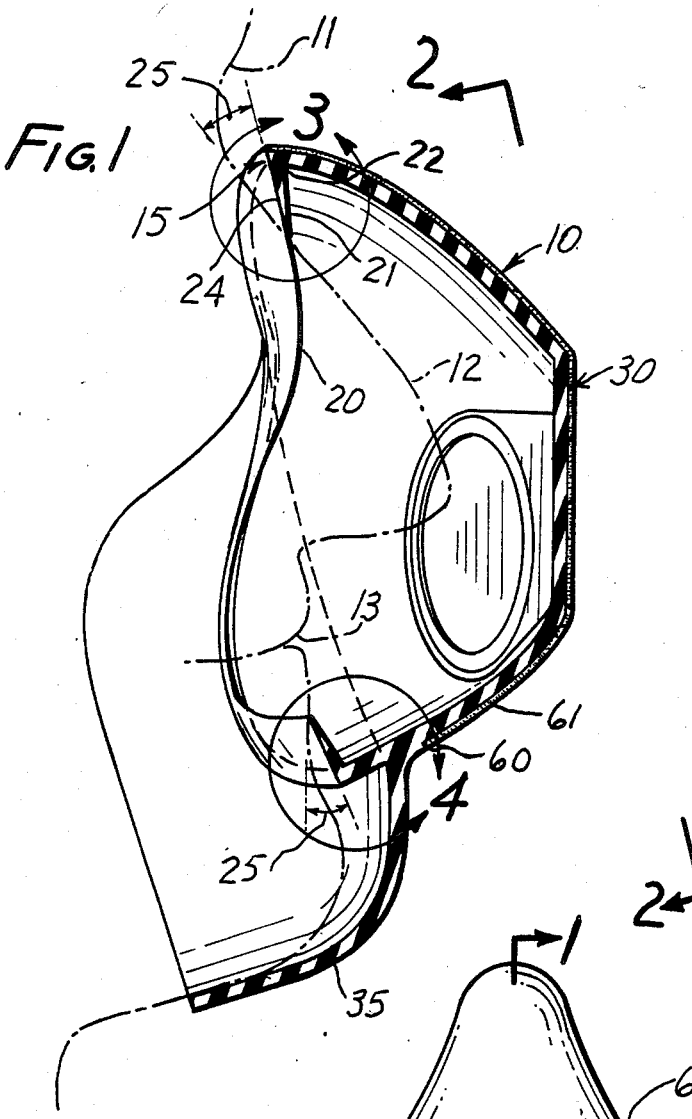
FIG. 1 is a cross-section view, partly in schematic notation showing the presently preferred embodiment of the invention.

FIG. 1 shows a mask 10 making its initial contact with a face 11 of a wearer. The wearer's nose 12, mouth 13, and mental protuberance 14 (best shown in FIG. 4) are shown. The mask has a sealing boundary 15 which extends over the bridge of the nose at each side of the nose and mouth and across the mental protuberance.

The term "mental protuberance" is used to describe the ledge-like construction formed adjacent to the base of the incisive fossa by the upper surface of the chin as it extends forwardly. While the term principally means this bony structure, it is used herein to define that region as "felt" through the skin. Thus, as used herein, the term "mental protuberance" means the entire structure—bone plus overlaying skin, so the seal meets the skin, but is supported by the underlying bony structure.

A primary seal 20 is a reflective seal. It comprises a readily flexible flange 21 with a base edge 22 and a free edge 23. Between these edges there is a smooth sealing surface 24 facing towards the wearer. Seal 20 is configured so that on the average face to which it is to be fitted, the free end makes first contact, and at that time surface 24 forms an acute angle 25 with the skin substantially all the way around the sealing boundary. This means that the surface has an undulating and twisting configuration, because the skin does. Angle 25 is preferably about 30 degrees, but substantial variations from this angle are permissible so long as an effective seal can be made.

Seal 20 integrally and continuously joins at its base edge 22 to a canopy 30. The canopy extends over the nose and mouth. It can be ported as at ports 31, 32 to accommodate hoses or hose connections for breathing gases. A flat central region 33 frequently passes microphone connections.

A shield 35 extends outwardly from the sealing boundary, along and depending under the chin, below the mental protuberance, and upwardly at each side of the mouth and nose to an elevation just beneath that of the bridge of the nose. It extends to cover part of each cheek, and cups under the tip of the chin. It is relatively heavy-walled so it gives some structural integrity to the mask, and resists upward movement of the mask relative to the face. It makes surface contact with the cheeks and chin to assist in locating the mask on the face. There will be straps to hold the mask in place, as will later be described. The straps also stabilize the mask.

The shield is flexible enough near the face to accommodate reasonable movements of the jaw without a special effort of the wearer. Such movements accommodate speech, for example.

A secondary seal extends areound the boundary. Its pressure face 41 (sometimes called a "pressure surface") is a continuation of sealing surface 24, and is also a continuation of the canopy wall.

Figure 4:
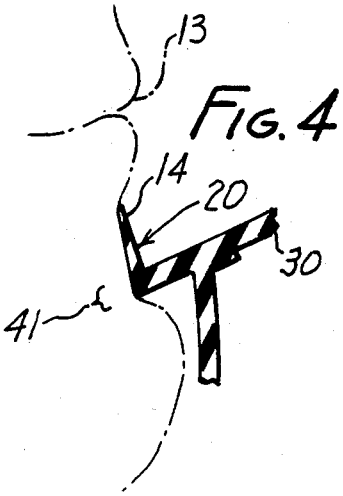
Figure 5:
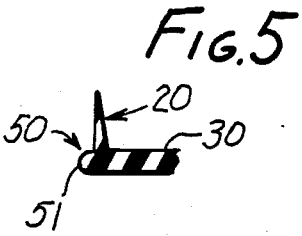
FIG. 5 is a fragmentary cross-section showing a variation of the secondary seal.

FIG. 5 shows that the secondary seal 50 can, instead of being a flush and continous surface 24, project beyond the sealing surface of the flange. This is a useful, but less comfortable construction. Its rounded pressure face 51 will usually continuously contact the face, but not so strongly and substantially as always to indent it and form a strong seal. However, when the mask is drawn more tightly against the face this secondary seal will make a deeper indention before deforming sealing surface 24 than the seal of FIGS. 1–4.

The embodiment of FIGS. 1–4 will usually be preferred. When its secondary seal is not pressed into the skin it will cause no discomfort, and will not be continuously indented. It is sufficiently thick that it will retain its configuration when pressed against the face.

The masks may conveniently be made of silicone rubber or latex rubber, both of which are elastomeric materials that can be molded to shape. The free length of the primary seal from edge to edge is about 7/16 inches. The thickness of the flange at its base is about 1/16 inches. The thickness of the secondary seal, of the canopy, and the canopy, are about ⅛ inch. The material is about 45 Shore A. The greater thickness of the secondary seal makes it relatively more rigid than the primary seal.

Figure 2:
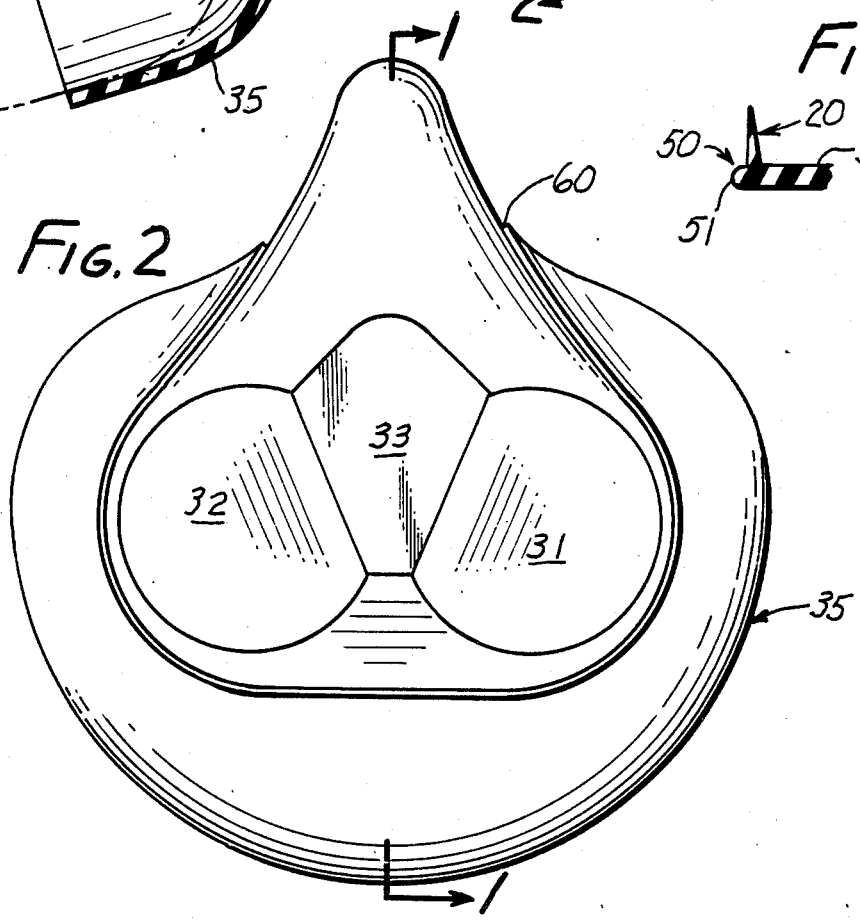
FIG. 2 is a front view of the mask in FIG. 1, with cap 61 removed.

In use, means is needed to hold the mask against the face, relatively lightly under less stringent conditions and relatively more strongly under more stringent conditions. The construction of the sealing boundary is such that a movement of about 3/16 inches of motion form initial contact with the face will cause the secondary seal to be fully made. There are many suitable means to draw the mask toward and against the face, but the most convenient one, and an optional feature of this invention is best shown in FIGS. 1 and 2.

A ledge 60 is formed around the major portion of the canopy extending from the mental protuberance up at both sides of the mouth and the nose to an elevation somewhat beneath the bridge of the nose. This ledge is aligned with a portion of the secondary seal and is adapted to receive forces to place the secondary seal under load. These forces are in turn applied to the ledge by a rigid cap 61 which fits over the canopy and has an edge that bears against ledge 60. The cap is rigid and may be made of materials such as fiberglass laminate molded to shape. It not only is able to exert force against the ledge, but also prevents the mask from ballooning from the differential pressures. It will be ported as necessary.

A strap can be attached around the head to the cap to draw the cap and thereby the mask toward the face. In order to respond to pressure differentials, a bladder may be placed between the wearer's head and a helmet or the straps so that as it expands with decreasing ambient pressures, it exerts an increasing pressure which pulls on the straps to draw the cap toward the face of the wearer.

This mask can be made relatively small in size so that its lift off area is not much more than about 12 square inches. At a differential pressure of about 70 mm Hg, this exerts a force of approximately 16.2 pounds. The bladder should preferably have a projected area about 30–50% larger than that of the mask for most comfort and best efficiency. The path of the sealing boundary is such as to minimize the effective area of the mask, so as to minimize the force which must be exerted in order to pull in the secondary seal as the differential pressure increases.

Figure 3:
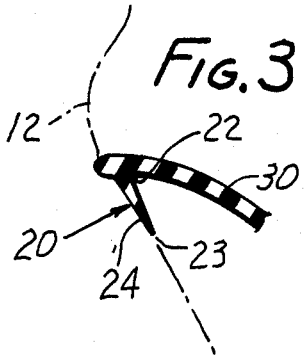
FIGS. 3 and 4 are fragmentary cross-sections taken at lines 3 and 4 in FIG. 1.

In use, the mask is placed on the face and the straps are drawn up so that the sealing surface 24 lies against the skin and is somewhat deflected but not so tightly as significantly to indent the skin with the secondary seal. The bladder, when used, does not at that time exert a substantial force on the straps. The reflective seal is the primary, and at low differential pressures, the only seal relied upon. The secondary seal of course may have some effect, but is not then primarily relied upon. When higher differential pressures are encountered, such as at higher altitudes, the straps will be tightened by the expanded bladder to draw the mask more tightly against the face. Now the secondary seal does indent the skin as shown in FIGS. 3, 4 and 5. The reflective seal continues to lay against the skin, and continues to provide some sealing action, but under sufficient differential pressures it might not have been sufficient alone. The stronger, more positive force-type secondary seal is effective. It will be released, however, as soon as the need for its stringency terminates.

Providing the face of the secondary seal as a continuation of the sealing surface 24 (FIG. 1) provides for a comfortable fit. However, having it project beyond the surface 24 as shown in FIG. 5 provides additional indentation without accompanying distortion of the base edge of the flange. Either arrangement is satisfactory.

This mask provides a reliable seal for pressure breathing over a wide range of differential pressures, which is also comfortable to the wearer, and which applies its most stringent forces only when needed. The net area that develops a separative force is minimized. By having a part of the path of the sealing boundary at the mental protuberance, the mask will be restrained from slipping downwardly along the face when negative G forces are exerted on it.

This invention is not to be limited by the embodiments shown in the drawings and described in the description which are given by way of example and not of limitation, but only in accordance with the scope of the appended claims.

I claim:

1. A face mask for pressure breathing comprising: a body having a sealing boundary shaped to fit over the bridge of the wearer's nose, downward past both sides of his nose and mouth, and across his mental protuberance, so as to make a fluid sealing contact along said boundary, said sealing boundary including a reflective primary seal, a secondary seal substantially non-deflectible with respect to said primary seal, and a canopy extending from said boundary to overlay the region included by said boundary, said canopy including means adapted to be connected to a breathing hose, said primary seal extending entirely around said sealing boundary and comprising a readily flexible flange having a base edge and a free edge, and between them and facing away from the canopy, a sealing surface, said sealing suface being so shaped and arranged as to form an acute angle with the face around substantially all of its length, before substantial deflection, and to lay against the wearer's face when the mask is pressed sufficiently against the wearer's face, said secondary seal extending entirely around said sealing boundary and being more rigid than said primary seal, said secondary seal extending along said boundary on the other side of said sealing boundary from said free edge and so disposed and arranged as to not substantially indent the skin when the primary seal first touches the face, but to be drawn against and indented into the skin when pressed sufficiently tightly against the face by force exerted toward the face mask in alignment with said secondary seal;

2. A mask according to claim 1 in which the mask is constructed of elastomeric material.

3. A mask according to claim 2 in which said flange tapers narrowingly in a plane normal to its base edge as it extends from its base edge to its free edge.

4. A mask according to claim 2 in which said secondary seal has a pressure surface which is continuation of the sealing surface on said flange on the other side of the structure from said free edge.

5. A mask according to claim 2 in which said secondary seal includes a projection which extends beyond the said sealing surface.

6. A mask according to claim 1 in which a ledge is formed along a substantial portion of the peripheral length of the boundary seal, generally aligned with said secondary seal, so as to receive a force and exert it in compressive relationship onto said secondary seal.

7. A face mask according to claim 1 further including a rigid cap so shaped and arranged as to fit over said canopy and force said boundary seal against the face of the wearer when said cap is pressed toward the wearer's face.

8. A face mask according to claim 7 in which a ledge is formed along a substantial portion of the peripheral length of the boundary seal, generally aligned with said secondary seal, so as to receive a force and exert it in compressive relationship onto said secondary seal, said cap being shaped to bear against said ledge to apply said force.

9. A mask according to claim 8 in which said cap and said canopy generally fit against one another.

* * * * *